US012161221B2

(12) United States Patent
Ge

(10) Patent No.: US 12,161,221 B2
(45) Date of Patent: Dec. 10, 2024

(54) DETACHABLE SHELF

(71) Applicants: Qingdao Fuyou Tools Co., Ltd, Qingdao (CN); Qingdao Lanshan Trade Co., Ltd, Qingdao (CN); Qingdao northern lights Furniture Co., Ltd, Qingdao (CN)

(72) Inventor: Zhiqiang Ge, Qingdao (CN)

(73) Assignees: QINGDAO FUYOU TOOLS CO., LTD., Qingdao (CN); QINGDAO LANSHAN TRADE CO., LTD., Qingdao (CN); QINGDAO NORTHERN LIGHTS FURNITURE CO., LTD., Qingdao (CN)

( * ) Notice: Subject to any disclaimer, the term of this patent is extended or adjusted under 35 U.S.C. 154(b) by 179 days.

(21) Appl. No.: 17/951,813

(22) Filed: Sep. 23, 2022

(65) Prior Publication Data

US 2023/0263300 A1 Aug. 24, 2023

(30) Foreign Application Priority Data

Feb. 22, 2022 (CN) ..... 202220367474.X

(51) Int. Cl.
*A47B 57/00* (2006.01)
*A47B 57/26* (2006.01)

(52) U.S. Cl.
CPC ..... *A47B 57/265* (2013.01)

(58) Field of Classification Search
CPC ..... A47B 57/265; A47B 57/50; A47B 57/40; A47B 57/34; A47B 47/0083;
(Continued)

(56) References Cited

U.S. PATENT DOCUMENTS 3,294,250 A * 12/1966 Evans ..... A47B 57/22 108/147.15
3,862,691 A * 1/1975 Mori ..... A47B 57/40 108/156

(Continued)

FOREIGN PATENT DOCUMENTS

FR 2782350 A1 * 2/2000 ..... A47B 57/22
GB 2354934 A * 4/2001 ..... A47B 57/50

(Continued)

OTHER PUBLICATIONS

Notice of Grant in corresponding Chinese Application No. 202220367474.X, dated May 25, 2022; 3 pgs.

*Primary Examiner* — Janet M Wilkens
(74) *Attorney, Agent, or Firm* — HAUPTMAN HAM, LLP

(57) ABSTRACT

A detachable shelf including four column assemblies, where each column assembly includes a plurality of columns distributed along a height direction; in each column assembly, adjacent columns are detachably connected; a plurality of support frames are disposed along the height direction among the four column assemblies; the support frame includes two mutually-parallel first cross beams and two mutually-parallel second cross beams; the front first cross beam is detachably connected to corresponding columns at front left and right ends and the rear first cross beam is detachably connected to corresponding columns at rear left and right ends; the left second cross beam is detachably connected to corresponding columns at left front and rear ends, and the right second cross beam is detachably connected to corresponding columns at right front and rear ends.

11 Claims, 11 Drawing Sheets

(58) Field of Classification Search
CPC ... A47B 47/021; A47B 47/0058; A47B 96/06; A47B 96/1441; A47B 96/1408
USPC ..... 108/107, 109, 110, 147.15, 147.17, 108/147.11, 156, 180, 193; 211/134, 187, 211/153, 192, 191; 248/243, 220.41, 248/220.43, 221.11, 221.12, 224.8, 248/225.21, 225.11; 403/237, 254
See application file for complete search history.

(56) References Cited

U.S. PATENT DOCUMENTS 5,553,549 A * 9/1996 Nilsson ..... A47B 9/00 108/147.11
9,241,566 B1 * 1/2016 Chen ..... A47B 55/00
10,626,905 B1 * 4/2020 Chiu ..... A47B 57/545
11,202,502 B1 * 12/2021 Berry ..... A47B 47/0083
11,602,221 B1 * 3/2023 Beck ..... A47B 96/14
11,896,121 B2 * 2/2024 Globerman ..... A47B 47/0058
11,925,258 B2 * 3/2024 Chakraborthy ..... A47B 96/07
2005/0103733 A1 * 5/2005 Saltzberg ..... A47B 96/00 211/187
2006/0144809 A1 * 7/2006 Collins ..... A47B 57/406 211/191
2012/0000873 A1 * 1/2012 Fitzgerald ..... A47B 57/50 211/153
2016/0051044 A1 * 2/2016 Sabounjian ..... A47B 47/021 211/186
2017/0280875 A1 * 10/2017 Buckley ..... A47B 57/34
2019/0290000 A1 * 9/2019 Davis ..... A47B 96/021
2020/0305596 A1 * 10/2020 Min ..... A47B 96/068
2023/0270248 A1 * 8/2023 Hanlon ..... A47B 47/0083 211/187
2023/0389699 A1 * 12/2023 Shan ..... A47B 96/1441

FOREIGN PATENT DOCUMENTS

KR 101580274 B1 * 12/2015
KR 101842395 B1 * 3/2018
KR 20200141799 A * 12/2020

* cited by examiner

DETACHABLE SHELF

RELATED APPLICATIONS

The present application claims priority from Chinese Application Number 202220367474.X, filed Feb. 22, 2022, the disclosure of which is hereby incorporated by reference herein in its entirety.

TECHNICAL FIELD

The present utility model relates to the field of shelf technologies, and in particular to a detachable shelf.

BACKGROUND

Conventional shelves are mostly formed by welding various components and the finished shelves are difficult to dismount. Thus, after a shelf is assembled by welding, it cannot be dismounted for subsequent transportation but transported entirely, leading to handling difficulties and large occupation space in transportation process.

SUMMARY

The object of the present utility model is to provide a detachable shelf so as to overcome the above defects of the prior arts.

In order to achieve the above purposes, the present utility model adopts the following technical solution.

There is provided a detachable shelf, including four column assemblies distributed at four corners of a rectangle, where each column assembly includes a plurality of columns distributed along a height direction; in each column assembly, adjacent columns are detachably connected.

A plurality of support frames are disposed along the height direction among the four column assemblies.

The support frame includes two mutually-parallel first cross beams and two mutually-parallel second cross beams for forming a rectangular frame structure; a length of the first cross beam is greater than a length of the second cross beam.

The front first cross beam is detachably connected to corresponding columns at front left and right ends and the rear first cross beam is detachably connected to corresponding columns at rear left and right ends.

The left second cross beam is detachably connected to corresponding columns at left front and rear ends, and the right second cross beam is detachably connected to corresponding columns at right front and rear ends.

Preferably, a cross section of the column is a right-angle turning structure.

A plurality of fitting grooves are uniformly disposed along the height direction on each of two right-angle side plates of the column.

Preferably, a vertical section of the first cross beam is a C-shaped structure, and opening ends of two first cross beams of the support frame are opposed to each other.

An upper edge of the C-shaped structure of the first cross beam is bent perpendicularly and outwardly to form a first horizontal plate.

Two vertically-distributed catches for cooperation with corresponding fitting grooves on the corresponding column are disposed on outer side surfaces of left and right ends of a first vertical main plate of the first cross beam respectively.

Preferably, a vertical section of the second cross beam is a C-shaped structure, and opening ends of two second cross beams of the support frame are opposed to each other.

An upper edge of the C-shaped structure of the second cross beam is bent perpendicularly and outwardly to form a second horizontal plate.

Two vertically-distributed catches for cooperation with corresponding fitting grooves on the corresponding column are disposed on outer side surfaces of front and rear ends of a second vertical main plate of the second cross beam respectively.

Preferably, in each column assembly, corresponding right-angle side plates of adjacent columns are detachably connected through a connection piece.

A plurality of catches for cooperation with the corresponding fitting grooves on the corresponding column are uniformly disposed along the height direction on the connection piece.

Preferably, the fitting groove includes a circular fitting hole or square fitting hole located at upper portion and a rectangular fitting hole located at lower portion, which are mutually communicated.

A horizontal width of the rectangular fitting hole is less than a diameter of the circular fitting hole or a horizontal width of the square fitting hole.

Preferably, the fitting groove includes a circular fitting hole or square fitting hole located in middle portion and rectangular fitting holes located at upper and lower portions, which are mutually communicated.

Horizontal widths of the rectangular fitting holes located at upper and lower portions are same, and the horizontal width of the rectangular fitting hole is less than a diameter of the circular fitting hole or a horizontal width of the square fitting hole.

Preferably, the fitting groove includes a first fitting groove and a second fitting groove symmetrically disposed, and the first fitting groove and the second fitting groove are spaced by a vertical spacing plate.

Each of the first fitting groove and the second fitting groove includes a semi-circular fitting hole or square fitting hole located at upper portion and a rectangular fitting hole or trapezoidal fitting hole located at lower portion.

A horizontal width of the rectangular fitting hole or trapezoidal fitting hole is less than a radius of the semi-circular fitting hole or a horizontal width of the square fitting hole.

Preferably, an arc-shaped protrusion facing toward the rectangular fitting hole or trapezoidal fitting hole is disposed at a position of the vertical spacing plate close to a top of the rectangular fitting hole or trapezoidal fitting hole.

Preferably, the catch includes two symmetrically-disposed L-shaped fitting blocks with opening ends disposed away from each other.

The two L-shaped fitting blocks of the catch are inserted into the circular fitting hole or square fitting hole or semi-circular fitting hole from an inner side of the corresponding column and then pressed down to be insertion-mated with the rectangular fitting hole or trapezoidal fitting hole at lower portion.

Preferably, an outer end of the L-shaped fitting block is in an arc shape or triangular shape, or trapezoidal shape or rectangular shape or B shape.

Preferably, a middle portion of an outer side surface of the first vertical main plate of the first cross beam is inwardly recessed and a middle portion of an inner side surface thereof is outwardly protruded, so as to form a first reinforcing portion.

Preferably, a middle portion of an outer side surface of the second vertical main plate of the second cross beam is inwardly recessed and a middle portion of an inner side surface thereof is outwardly protruded, so as to form a second reinforcing portion.

Preferably, in the support frame, a pull beam is perpendicularly disposed between respective middle portions of two first cross beams and two ends of the pull beam are insertion-mated with the corresponding first cross beams.

The present utility model has the following beneficial effects.

In the detachable shelf provided by the present utility model, detachable insertion mating can be performed between the first cross beam and the column, the second cross beam and the column, the pull beam and the first cross beam, and the connection piece and the column. On one hand, the assembling of the shelf can be simplified, and on the other hand, detachable connection is performed between various components forming the shelf. Thus, a detachable structure can be formed for the shelf, such that transportation can be carried out for disassembled components. In this way, the problems of handling difficulty and large occupation space during transportation process can be resolved.

BRIEF DESCRIPTION OF THE DRAWINGS

The drawings forming a part of the present application can be used to provide further understanding for the present application. The illustrative embodiments of the present application and relevant descriptions are used to explain the present application and do not constitute limitation to the present application.

NUMERALS OF THE DRAWINGS ARE DESCRIBED AS FOLLOWS

1. column, 11. fitting groove, 12. first fitting groove, 13. second fitting groove, 14. vertical spacing plate, 15. arc-shaped protrusion, 111. circular fitting hole, 112. rectangular fitting hole, 113. square fitting hole, 114. trapezoidal fitting hole,

2. first cross beam, 21. first vertical main plate, 22. first horizontal plate, 23. first reinforcing portion, 24. rectangular groove, 25. first fitting slot,

3. second cross beam, 31. second vertical main plate, 32. second horizontal plate, 33. second reinforcing portion,

4. catch, 41. L-shaped fitting block,

5. connection piece,

6. pull beam, 61. upper groove, 62. upper insertion portion, 63. lower groove, 64. lower insertion portion.

DETAILED DESCRIPTION OF THE EMBODIMENTS

It should be pointed out that the following detailed descriptions are illustrative and intended to provide further understanding for the present application. Unless otherwise indicated, all technical and scientific terms used herein have the same meaning as persons of ordinary skill in the art can usually understand.

The present utility model is further described below in combination with accompanying drawings and embodiments.

Figure 1:
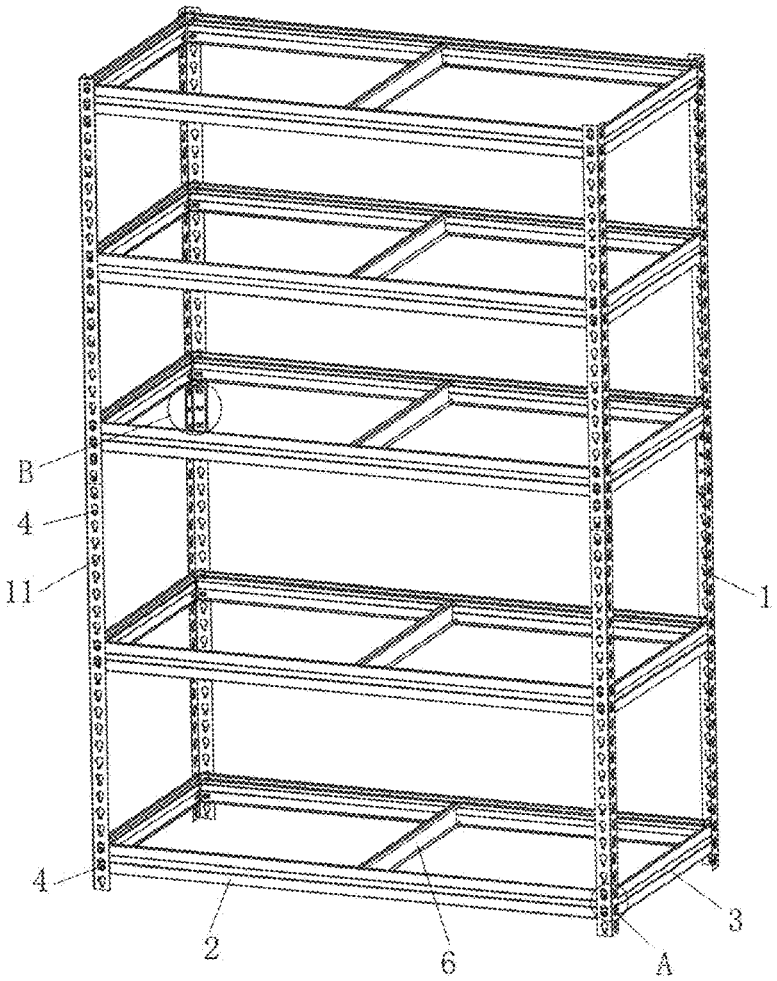
FIG. 1 is an illustrative stereoscopic diagram of a structure of a detachable shelf according to embodiment 1 of the present utility model.
Figure 2:
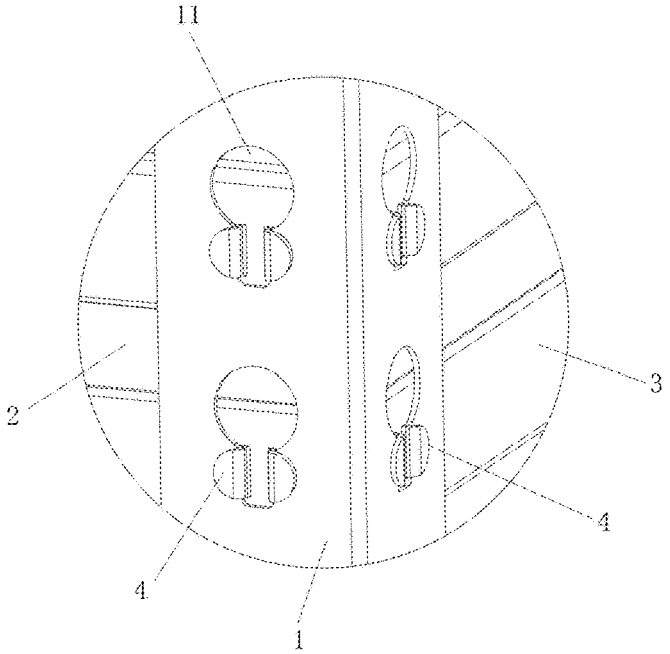
FIG. 2 is a partially-enlarged diagram of a position A in FIG. 1.
Figure 3:
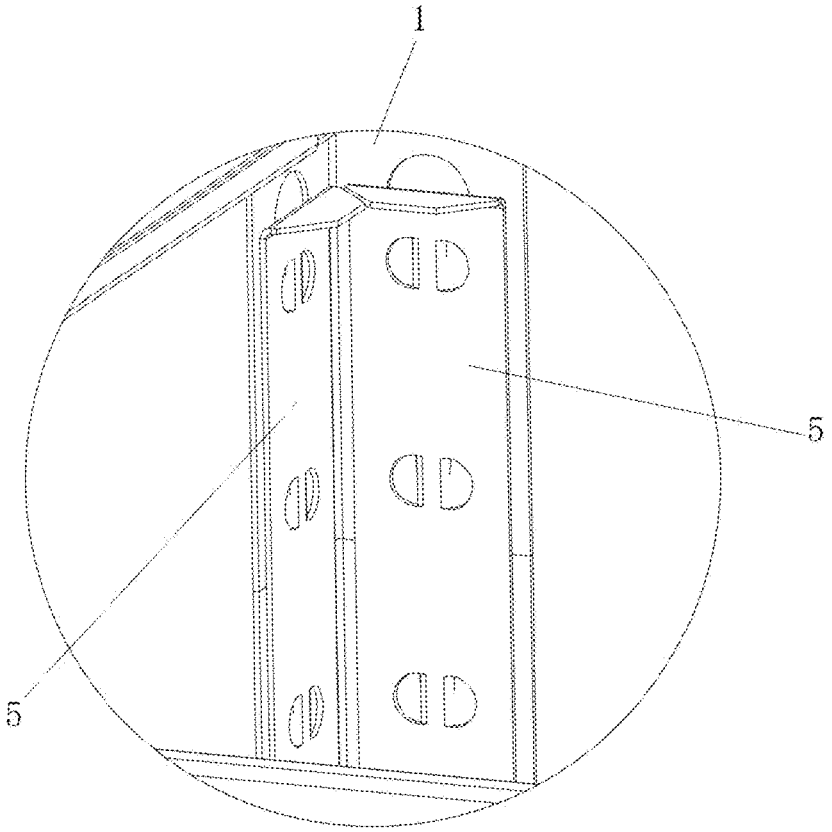
FIG. 3 is a partially-enlarged diagram of a position B in FIG. 1.

As shown in FIGS. 1 to 3, provided is a detachable shelf, including four column assemblies distributed at four corners of a rectangle, where each column assembly includes a plurality of columns 1 distributed along a height direction; in each column assembly, adjacent columns 1 are detachably connected, such that a height of the column assembly can be adjusted so as to enable the entire shelf to be adjustable in height.

A plurality of support frames are disposed along the height direction among the four column assemblies.

The support frame includes two mutually-parallel first cross beams 2 and two mutually-parallel second cross beams 3 for forming a rectangular frame structure; a length of the first cross beam 2 is greater than a length of the second cross beam 3.

The front first cross beam 2 is detachably connected to corresponding columns 1 at front left and right ends and the rear first cross beam 2 is detachably connected to corresponding columns 1 at rear left and right ends.

The left second cross beam 3 is detachably connected to corresponding columns 1 at left front and rear ends, and the right second cross beam 3 is detachably connected to corresponding columns 1 at right front and rear ends.

Figure 4:
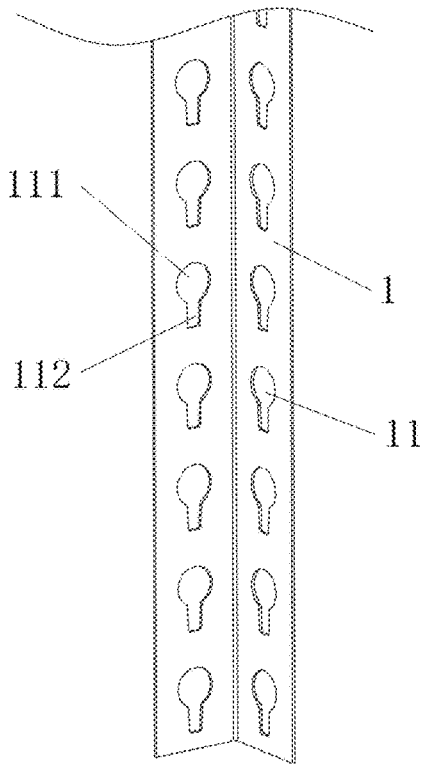
FIG. 4 is a structural schematic diagram of a column according to embodiment 1 of the present utility model.
Figure 5:
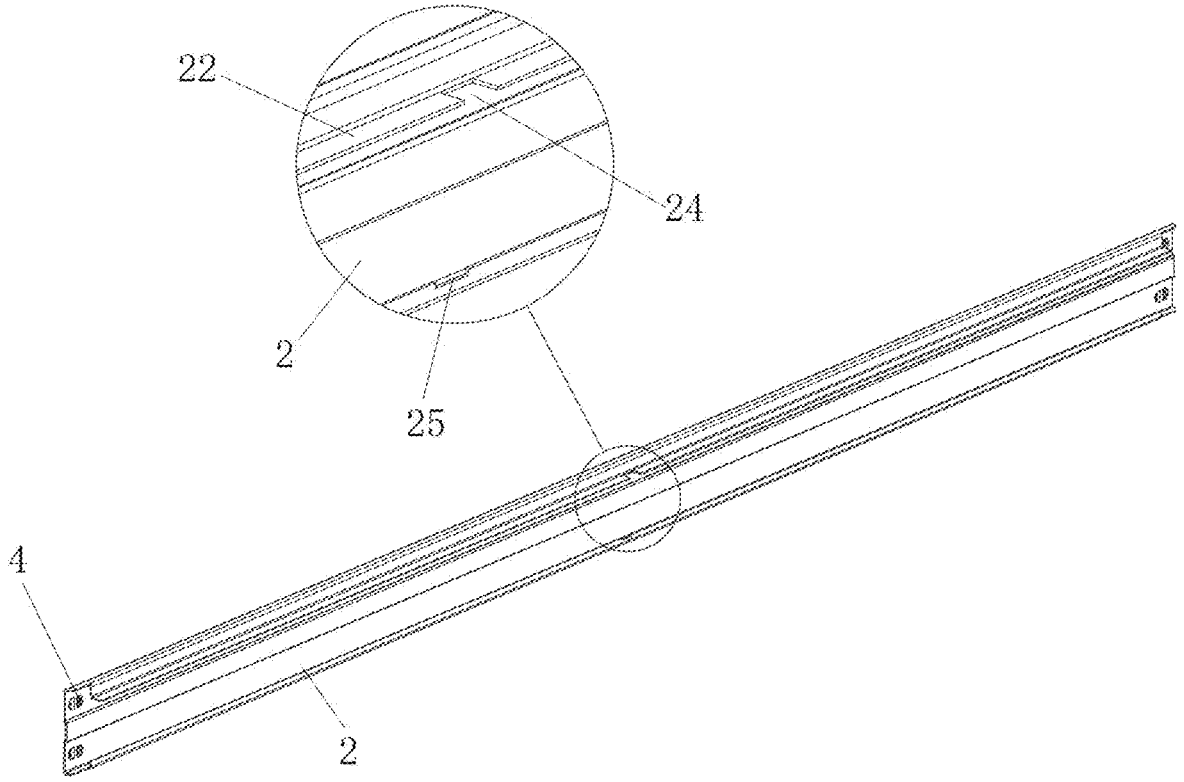
FIG. 5 is an illustrative stereoscopic diagram of a structure of a first cross beam according to embodiment 1 of the present utility model.
Figure 6:
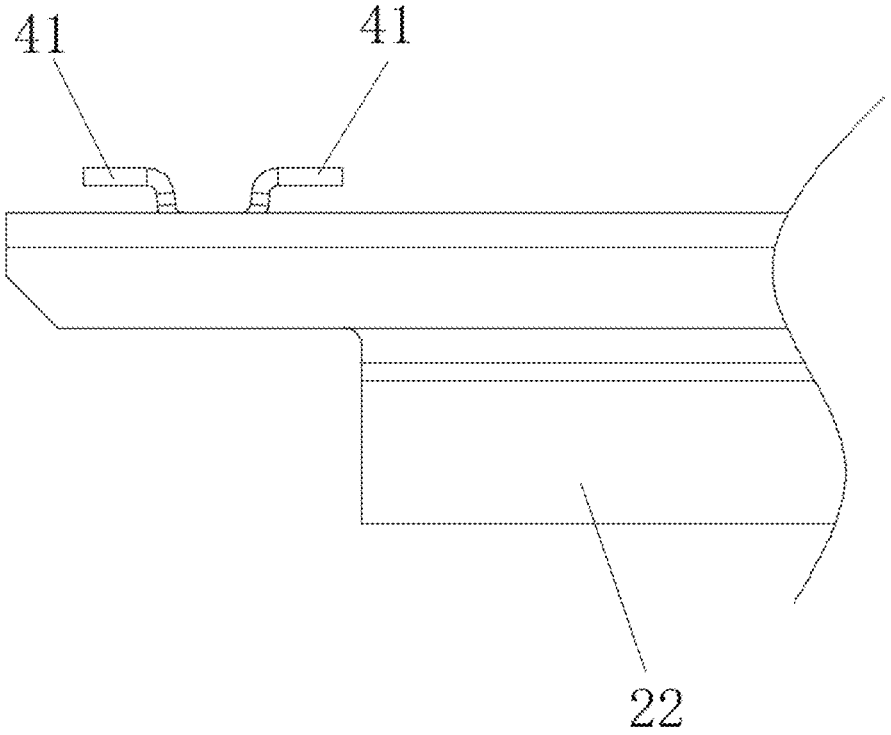
FIG. 6 is an illustrative top view of a structure of a first cross beam according to embodiment 1 of the present utility model.

Preferably, as shown in FIG. 4, a cross section of the column 1 is a right-angle turning structure. The left two column assemblies and the right two column assemblies are symmetrically disposed and the front two column assemblies and the rear two column assemblies are symmetrically disposed. Further, right-angle internal ends of the four column assemblies are all disposed inwardly.

A plurality of fitting grooves 11 are uniformly disposed along the height direction on each of two right-angle side plates of the column 1.

Preferably, as shown in FIGS. 5 to 8, a vertical section of the first cross beam 2 is a C-shaped structure, and opening ends of two first cross beams 2 of the support frame are opposed to each other.

An upper edge of the C-shaped structure of the first cross beam 2 is bent perpendicularly and outwardly to form a first horizontal plate 22.

Two vertically-distributed catches 4 for cooperation with corresponding fitting grooves 11 on the corresponding column 1 are disposed on outer side surfaces of left and right ends of a first vertical main plate 21 of the first cross beam 2 respectively. The catches 4 on the first cross beam 2 cooperate with the fitting grooves 11 in the right-angle side plates extending along a left-right direction on the corresponding columns 1.

Preferably, as shown in FIGS. 9 to 12, a vertical section of the second cross beam 3 is a C-shaped structure, and opening ends of two second cross beams 3 of the support frame are opposed to each other.

An upper edge of the C-shaped structure of the second cross beam 3 is bent perpendicularly and outwardly to form a second horizontal plate 32.

Two vertically-distributed catches 4 for cooperation with corresponding fitting grooves 11 on the corresponding column 1 are disposed on outer side surfaces of front and rear ends of a second vertical main plate 31 of the second cross beam 3 respectively. The catches 4 on the second cross beam 3 cooperate with the fitting grooves 11 in the right-angle side plates extending along a back-forth direction on the corresponding columns 1.

Preferably, in each column assembly, corresponding right-angle side plates of adjacent columns 1 are detachably connected through a connection piece 5.

Figure 13:
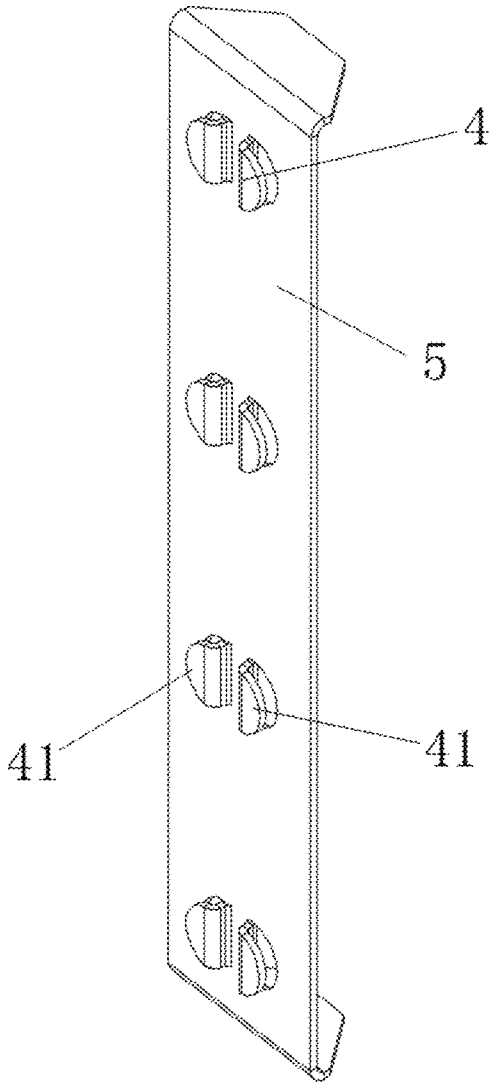
FIG. 13 is a structural schematic diagram of a connection piece according to embodiment 1 of the present utility model.

As shown in FIG. 13, a plurality of catches 4 for cooperation with the corresponding fitting grooves 11 on the corresponding column 1 are uniformly disposed along the height direction on the connection piece 5.

Preferably, as shown in FIG. 4, the fitting groove 11 includes a circular fitting hole 111 at upper portion and a rectangular fitting hole 112 located at lower portion, which are mutually communicated.

A horizontal width of the rectangular fitting hole 112 is less than a diameter of the circular fitting hole 111. Specifically, the fitting groove 11 is symmetrically disposed along a vertical direction.

Preferably, as shown in FIGS. 6, 8, 10, 12 and 13, the catch 4 includes two symmetrically-disposed L-shaped fitting blocks 41 with opening ends disposed away from each other.

The two L-shaped fitting blocks 41 of the catch 4 are inserted into the circular fitting hole 111 from an inner side of the corresponding column 1 and then pressed down to be insertion-mated with the rectangular fitting hole 112.

Outer ends of two L-shaped fitting blocks 41 of the catch 4 are arc-shaped structures such that the two L-shaped fitting blocks 41 are presented like butterfly wings, thus beautifying its external appearance.

Figure 7:
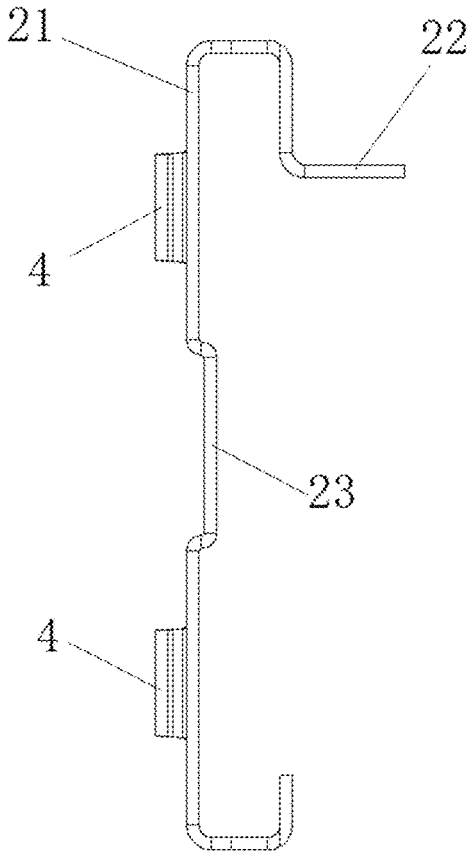
FIG. 7 is an illustrative left view of a structure of a first cross beam according to embodiment 1 of the present utility model.
Figure 8:
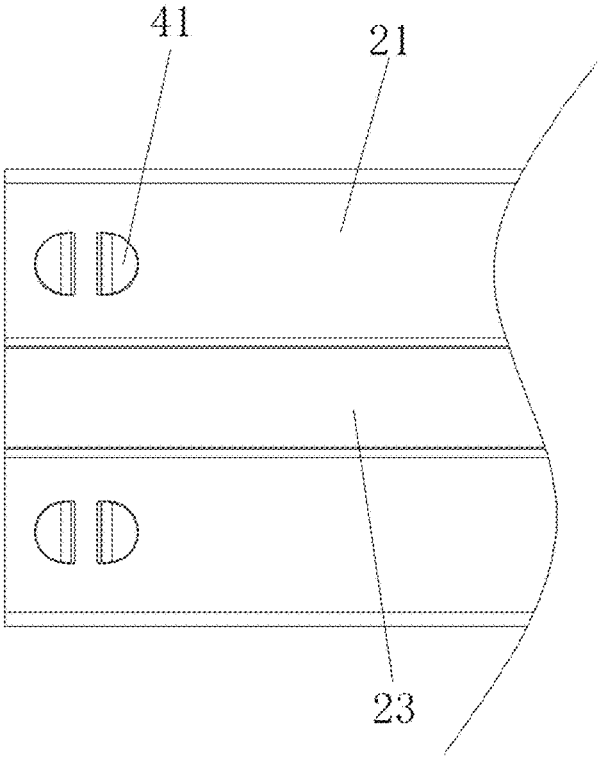
FIG. 8 is an illustrative rear view of a structure of a first cross beam according to embodiment 1 of the present utility model.
Figure 9:
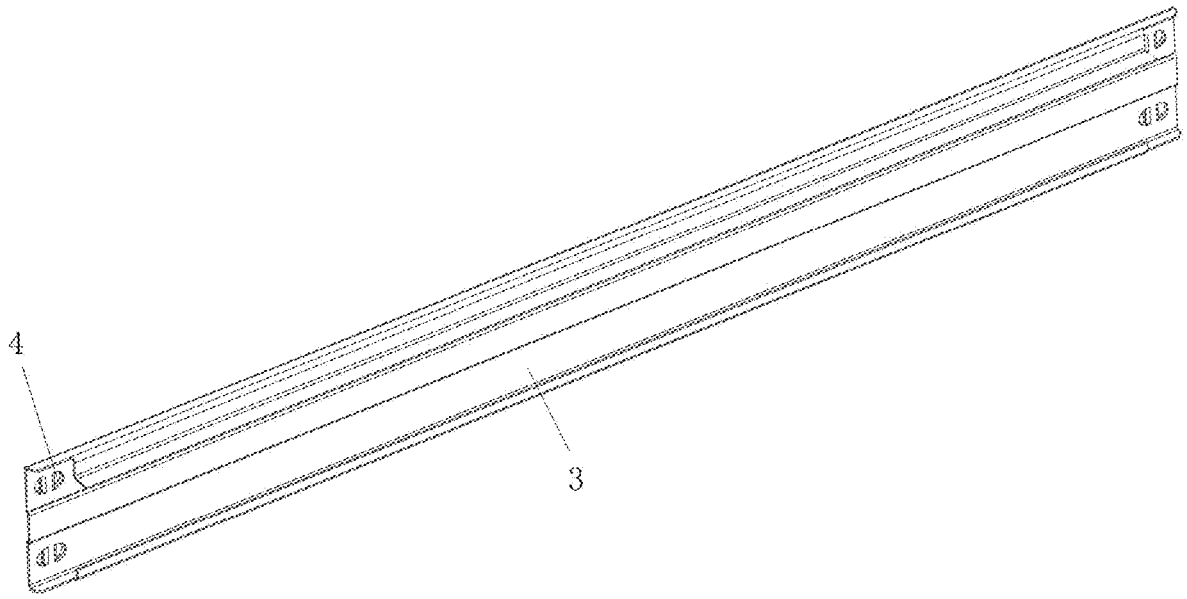
FIG. 9 is an illustrative stereoscopic diagram of a structure of a second cross beam according to embodiment 1 of the present utility model.
Figure 10:
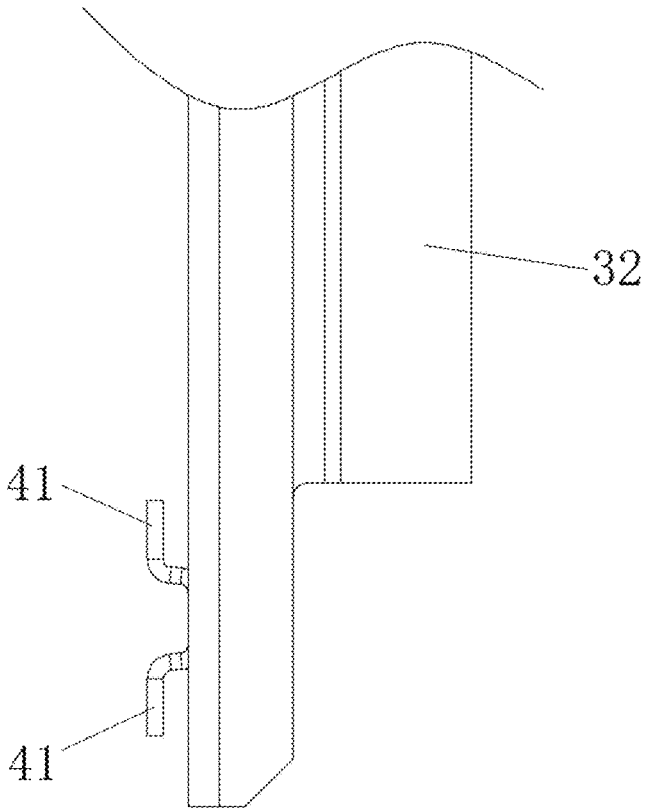
FIG. 10 is an illustrative top view of a structure of a second cross beam according to embodiment 1 of the present utility model.

Preferably, as shown in FIG. 7, a middle portion of an outer side surface of the first vertical main plate 21 of the first cross beam 2 is inwardly recessed and a middle portion of an inner side surface thereof is outwardly protruded, so as to form a first reinforcing portion 23. In this case, the first vertical main plate 21 of the first cross beam 2 is entirely formed into a concave-convex structure so as to increase a strength of the first cross beam 2.

Figure 11:
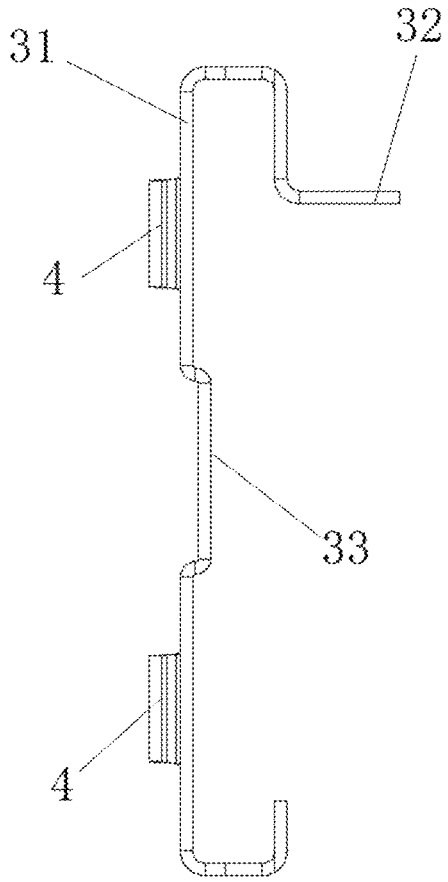
FIG. 11 is an illustrative front view of a structure of a second cross beam according to embodiment 1 of the present utility model.
Figure 12:
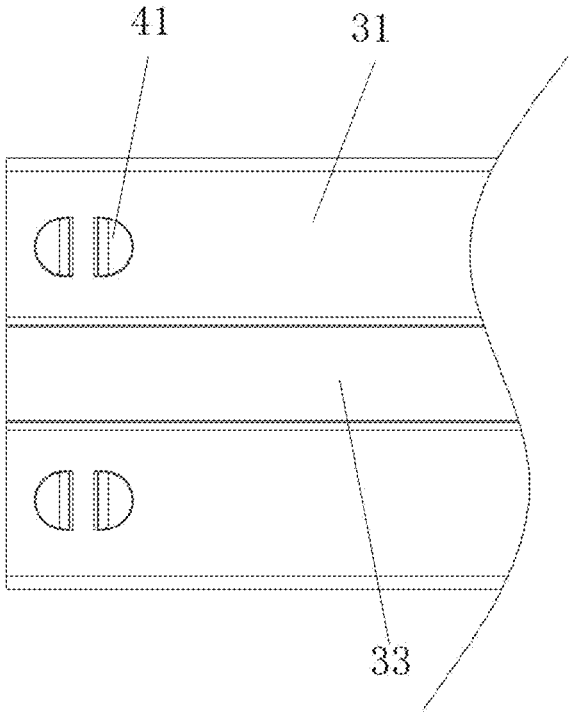
FIG. 12 is an illustrative left view of a structure of a second cross beam according to embodiment 1 of the present utility model.

Preferably, as shown in FIG. 11, a middle portion of an outer side surface of the second vertical main plate 31 of the second cross beam 3 is inwardly recessed and a middle portion of an inner side surface thereof is outwardly protruded, so as to form a second reinforcing portion 33. In this case, the second vertical man plate 31 of the second cross beam 3 is entirely formed into a concave-convex structure so as to increase a strength of the second cross beam 3.

Preferably, in the support frame, a pull beam 6 is perpendicularly disposed between respective middle portions of two first cross beams 2 and two ends of the pull beam 6 are insertion-mated with the corresponding first cross beams 2.

Figure 14:
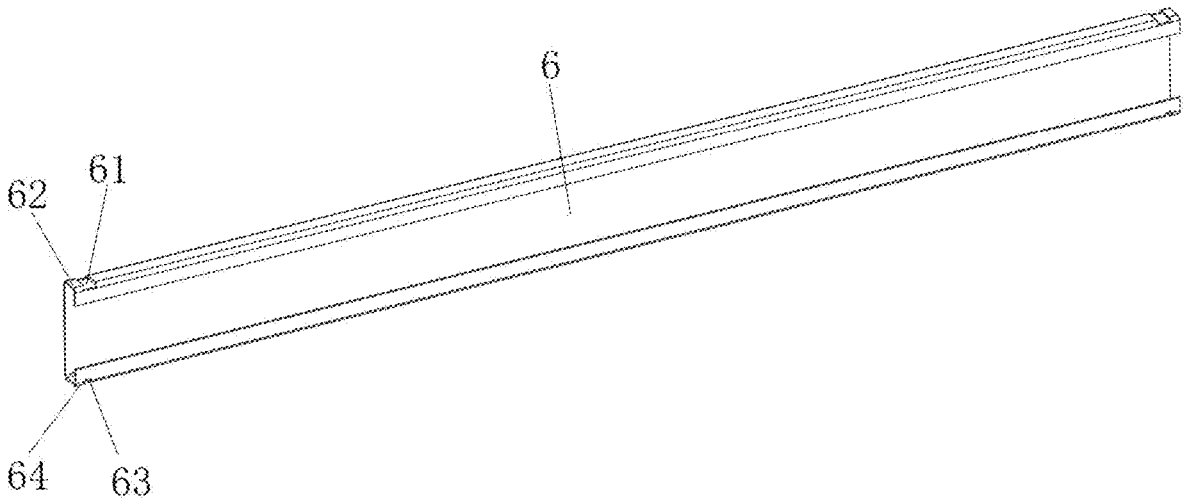
FIG. 14 is a schematic stereoscopic diagram of a structure of a pull beam according to embodiment 1 of the present utility model.
Figure 15:
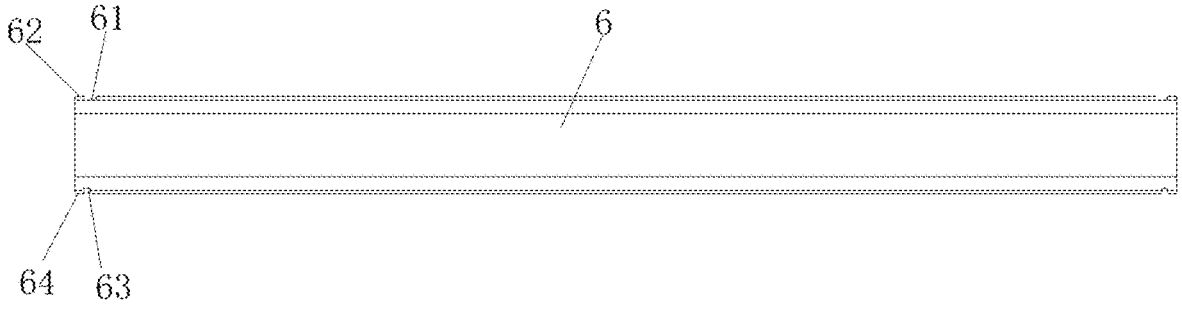
FIG. 15 is an illustrative right view of a structure of a pull beam according to embodiment 1 of the present utility model.

Specifically, as shown in FIGS. 14 to 15, a vertical section of the pull beam 6 is a C-shaped structure.

One upper groove 61 is disposed at two ends of the top of the pull beam 6 respectively such that an upper insertion portion 62 is formed respectively at the two ends of the top of the pull beam 6.

One lower groove 63 is disposed at two ends of the bottom of the pull beam 6 respectively such that an lower insertion portion 64 is formed respectively at the two ends of the bottom of the pull beam 6.

A rectangular groove 24 is disposed in a middle portion of the first horizontal plate 22 of the first cross beam 2, and a first fitting slot 25 is disposed on the C-shaped edge in a middle portion of the lower side of the first cross beam 2.

Figure 16:
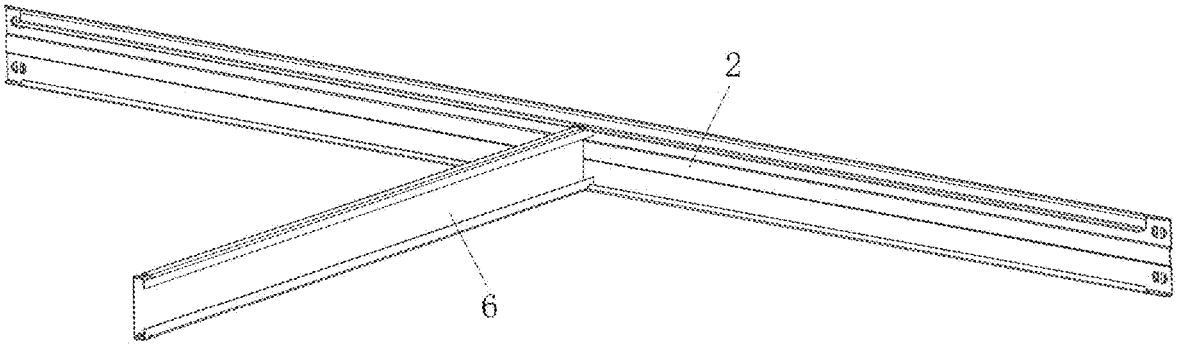
FIG. 16 is a stereoscopic diagram of cooperation of a pull beam and a first cross beam according to embodiment 1 of the present utility model.
Figure 17:
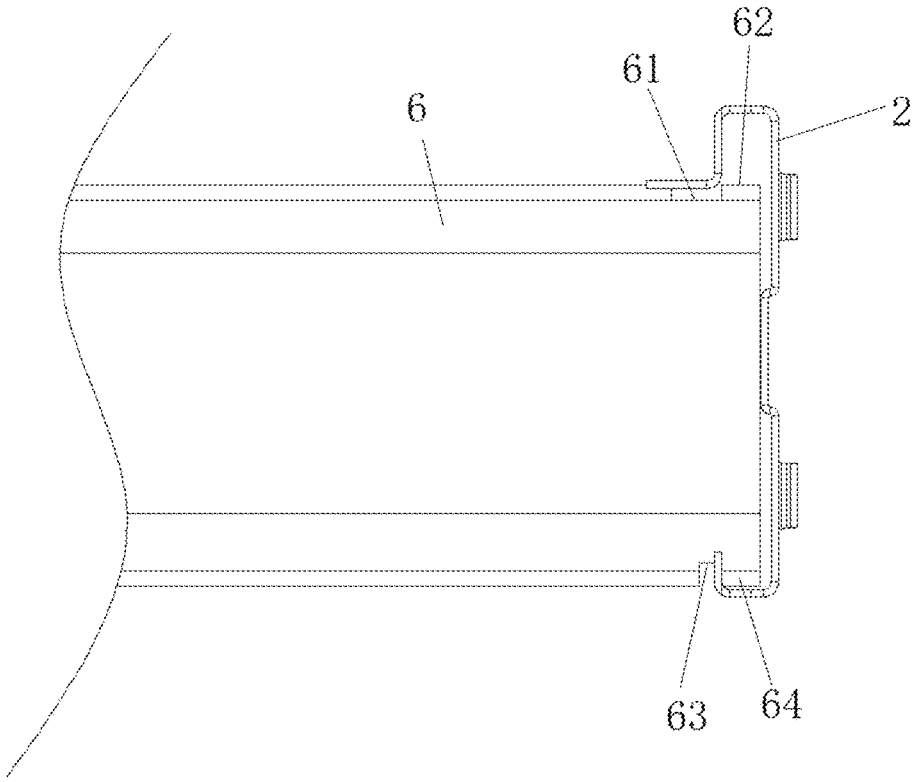
FIG. 17 is a right view of cooperation of a pull beam and a first cross beam according to embodiment 1 of the present utility model.
Figure 18:
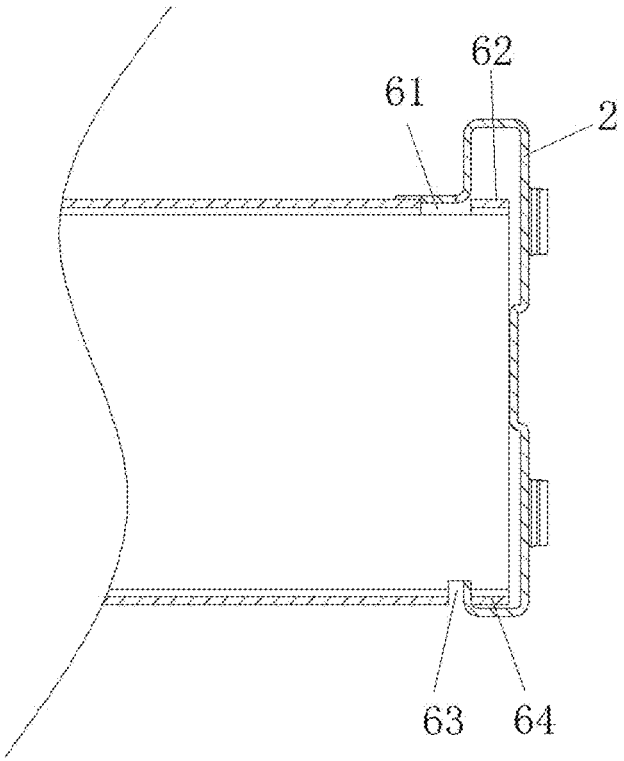
FIG. 18 is a sectional view of cooperation of a pull beam and a first cross beam according to embodiment 1 of the present utility model.

As shown in FIGS. 16 to 18, the lower grooves 63 of the pull beam 6 cooperate with the corresponding first fitting slots 25, the lower insertion portions 64 of the pull beam 6 are located in grooves at the lower portions of the C-shaped structures of the first cross beams, and the upper insertion portions 62 of the pull beam 6 are located in grooves at upper portions of the C-shaped structures of the first cross beams.

When the pull beam 6 is assembled to the first cross beam 2, the upper insertion portion 62 of the corresponding end of the pull beam 6 is firstly inserted into the groove at the upper portion of the C-shaped structure of the first cross beam through the rectangular groove 24, and then the lower insertion portion 64 of this end is inserted into the first cross beam 2 and then the pull beam 6 is pressed down to enable the lower groove 63 of the pull beam 6 to fitted with the first fitting slot 25. At this time, the lower insertion portion 64 of the pull beam 6 is located in the groove at the lower portion of the C-shaped structure of the first cross beam and thus insertion mating between the pull beam 6 and the first cross beam 2 can be achieved. The disposal of the rectangular groove 24 in the first cross beam 2 helps the upper insertion portion 62 of the pull beam 6 to be inserted into the groove at the upper portion of the C-shaped structure of the first cross beam.

In the detachable shelf provided by the present application, detachable insertion mating can be performed between the first cross beam 2 and the column 1, the second cross beam 3 and the column 1, the pull beam 6 and the first cross beam 2, and the connection piece 5 and the column 1. On one hand, the assembling of the shelf can be simplified, and on the other hand, detachable connection is performed between various components forming the shelf. Thus, a detachable structure can be formed for the shelf, such that transportation can be carried out for disassembled components. In this way, the problems of handling difficulty and large occupation space during transportation process can be resolved.

Embodiment 2

Figure 19:
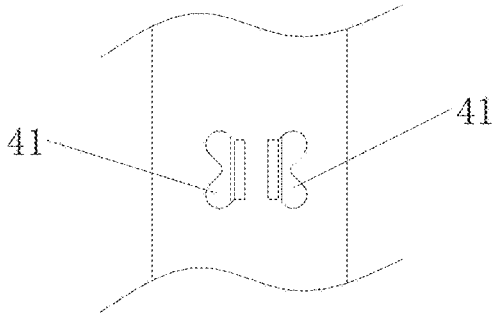
FIG. 19 is a structural schematic diagram of a catch according to embodiment 2 of the present utility model.

As shown in FIG. 19. the embodiment 2 provides a detachable shelf, which differs from the embodiment 1 in that: in this embodiment, the outer ends of the two L-shaped fitting blocks 41 of the catch 4 are in B shape, such that the two L-shaped fitting blocks 41 are more like butterfly wings, thus beautifying the external appearance.

In addition, the width of the catch 4 is less than the diameter of the circular fitting hole 11 to ensure the catch 4 can be inserted into the circular fitting hole 111.

Embodiment 3

Figure 20:
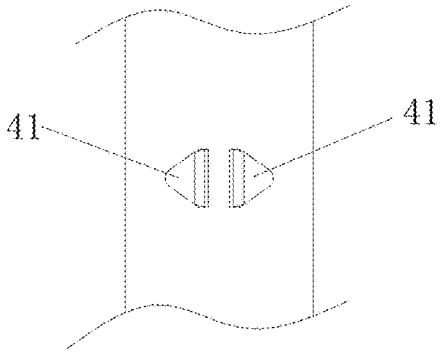
FIG. 20 is a structural schematic diagram of a catch according to embodiment 3 of the present utility model.

As shown in FIG. 20, the embodiment 3 provides a detachable shelf, which differs from the embodiment 1 in that: in this embodiment, the outer ends of the two L-shaped fitting blocks 41 of the catch 4 are in triangular shape.

Embodiment 4

Figure 21:
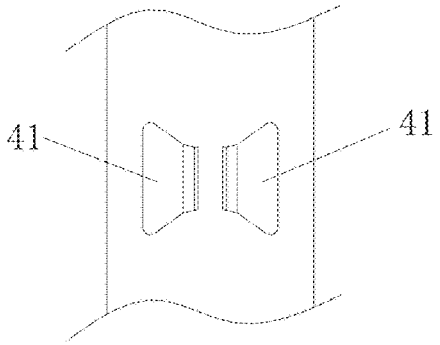
FIG. 21 is a structural schematic diagram of a catch according to embodiment 4 of the present utility model.

As shown in FIG. 21, the embodiment 4 provides a detachable shelf, which differs from the embodiment 1 in that: in this embodiment, the outer ends of the two L-shaped fitting blocks 41 of the catch 4 are in isosceles trapezoid shape.

Embodiment 5

Figure 22:
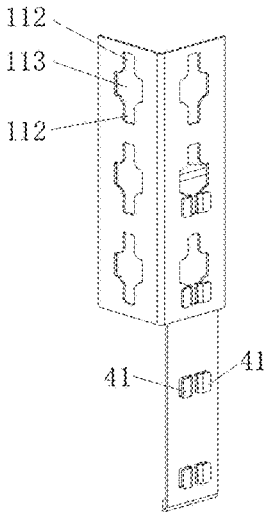
FIG. 22 is a structural schematic diagram illustrating a column and a connection piece according to embodiment 5 of the present utility model.

As shown in FIG. 22, the embodiment 5 provides a detachable shelf, which differs from the embodiment 1 in that: in this embodiment, the fitting groove 11 includes a square fitting hole 113 located in middle portion and rectangular fitting holes 112 located at upper and lower portions, which are mutually communicated; horizontal widths of the rectangular fitting holes 112 located at upper and lower portions are same, and the horizontal width of the rectangular fitting holes 112 located at upper and lower portions is less than a width of the square fitting hole 113: two L-shaped fitting blocks 41 of the catch 4 are inserted into the square fitting hole 113 from an inner side of the corresponding column 1 and then pressed down to achieve insertion mating with the rectangular fitting hole 112 at lower portion; and the above L-shaped fitting blocks 41 are rectangular.

Embodiment 6

Figure 23:
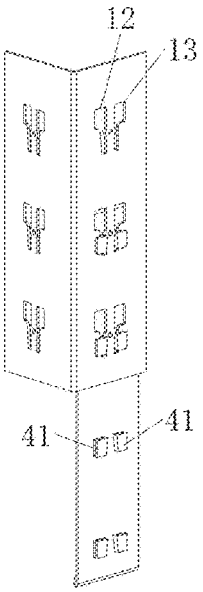
FIG. 23 is a structural schematic diagram illustrating a column and a connection piece according to embodiment 6 of the present utility model.
Figure 24:
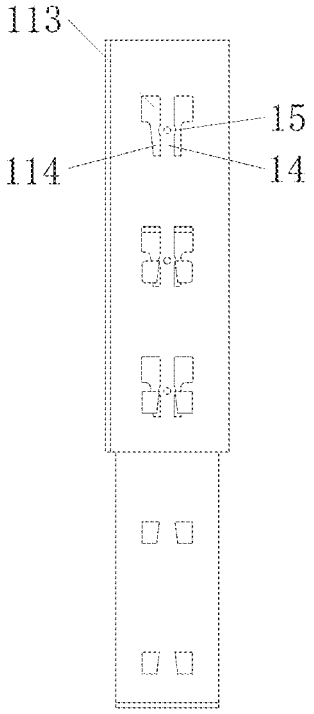
FIG. 24 is a schematic right view of a structure of a column and a connection piece according to embodiment 6 of the present utility model.

As shown in FIG. 23. the embodiment 6 provides a detachable shelf, which differs from the embodiment 1 in that: in this embodiment, the fitting groove 11 includes a first fitting groove 12 and a second fitting groove 13 symmetrically disposed. and the first fitting groove 12 and the second fitting groove 13 are spaced by a vertical spacing plate 14: each of the first fitting groove 12 and the second fitting groove 13 includes a square fitting hole 113 located at upper portion and a trapezoidal fitting hole 114 located at lower portion; a horizontal width of the trapezoidal fitting hole 114 is less than a horizontal width of the square fitting hole 113.

Furthermore, an arc-shaped protrusion 15 facing toward the trapezoidal fitting hole 114 is disposed at a position of the vertical spacing plate 14 close to a top of the trapezoidal fitting hole 114.

In this embodiment, two L-shaped fitting blocks 41 of the catch 4 are inserted into the square fitting hole 113 from the inner side of the corresponding column 1 and then pressed down to achieve insertion mating with the trapezoidal fitting hole 114 at lower portion and the arc-shaped protrusion 15 can realize limitation to the catch 4 to prevent the catch 4 from slipping out of the trapezoidal fitting hole 114, thus further improving the connection sturdiness.

In this embodiment, the two L-shaped fitting blocks 41 of the catch 4 are in non-isosceles trapezoid shape.

Although descriptions are made to the specific embodiments of the present utility model in combination with accompanying drawings, no limitation is made to the present utility model. Those skilled in the art should understand that various modifications or variations made by those skilled in the art based on the technical solution of the present utility model without making creative work still fall within the scope of protection of the present utility model.

The invention claimed is:

1. A detachable shelf, comprising four column assemblies distributed at four corners of a rectangle, wherein each column assembly comprises a plurality of columns distributed along a height direction; in each column assembly, adjacent columns are detachably connected;

a plurality of support frames is disposed along the height direction among the four column assemblies;

the support frame comprises two mutually-parallel first cross beams and two mutually-parallel second cross beams for forming a rectangular frame structure; a length of the first cross beam is greater than a length of the second cross beam;

the front first cross beam is detachably connected to corresponding columns at front left and right ends and the rear first cross beam is detachably connected to corresponding columns at rear left and right ends;

the left second cross beam is detachably connected to corresponding columns at left front and rear ends, and the right second cross beam is detachably connected to corresponding columns at right front and rear ends;

wherein a cross section of the column is a right-angle turning structure;

a plurality of fitting grooves is uniformly disposed along the height direction on each of two right-angle side plates of the column;

wherein a vertical section of the first cross beam is a C-shaped structure, and opening ends of two first cross beams of the support frame are opposed to each other;

an upper edge of the C-shaped structure of the first cross beam is bent perpendicularly and outwardly to form a first horizontal plate;

two vertically-distributed catches for cooperation with corresponding fitting grooves on the corresponding column are disposed on outer side surfaces of left and right ends of a first vertical main plate of the first cross beam respectively;

wherein, in the support frame, a pull beam is perpendicularly disposed between respective middle portions of two first cross beams and two ends of the pull beam are insertion-mated with the corresponding first cross beams;

a vertical section of the pull beam is a C-shaped structure;

one upper groove is disposed at two ends of the top of the pull beam respectively such that an upper insertion portion is formed respectively at the two ends of the top of the pull beam;

one lower groove is disposed at two ends of the bottom of the pull beam respectively such that a lower insertion portion is formed respectively at the two ends of the bottom of the pull beam;

a rectangular groove is disposed in a middle portion of the first horizontal plate of the first cross beam, and a first fitting slot is disposed on the C-shaped edge in a middle portion of the lower side of the first cross beam;

the lower grooves of the pull beam cooperate with the corresponding first fitting slots, the lower insertion portions of the pull beam are located in grooves at the lower portions of the C-shaped structures of the first cross beams, and the upper insertion portions of the pull beam are located in grooves at upper portions of the C-shaped structures of the first cross beams.

2. The detachable shelf according to claim 1, wherein a vertical section of the second cross beam is a C-shaped structure, and opening ends of two second cross beams of the support frame are opposed to each other;

an upper edge of the C-shaped structure of the second cross beam is bent perpendicularly and outwardly to form a second horizontal plate;

two vertically-distributed catches for cooperation with corresponding fitting grooves on the corresponding column are disposed on outer side surfaces of front and rear ends of a second vertical main plate of the second cross beam respectively.

3. The detachable shelf according to claim 2, wherein, in each column assembly, corresponding right-angle side plates of adjacent columns are detachably connected through a connection piece;

a plurality of catches for cooperation with the corresponding fitting grooves on the corresponding column are uniformly disposed along the height direction on the connection piece.

4. The detachable shelf according to claim 3, wherein the fitting groove comprises a circular fitting hole or square fitting hole located at upper portion and a rectangular fitting hole located at lower portion, which are mutually communicated;

a horizontal width of the rectangular fitting hole is less than a diameter of the circular fitting hole or a horizontal width of the square fitting hole.

5. The detachable shelf according to claim 4, wherein the catch comprises two symmetrically-disposed L-shaped fitting blocks with opening ends disposed away from each other;

the two L-shaped fitting blocks of the catch are inserted into the circular fitting hole or the square fitting hole or a semi-circular fitting hole from an inner side of the corresponding column and then pressed down to be insertion-mated with the rectangular fitting hole or a trapezoidal fitting hole at the lower portion.

6. The detachable shelf according to claim 5, wherein an outer end of the L-shaped fitting block is in an arc shape or triangular shape, or trapezoidal shape or rectangular shape or B shape.

7. The detachable shelf according to claim 5, wherein the fitting groove comprises a circular fitting hole or square fitting hole located in middle portion and rectangular fitting holes located at upper and lower portions, which are mutually communicated;

horizontal widths of the rectangular fitting holes located at upper and lower portions are same, and the horizontal width of the rectangular fitting hole is less than a diameter of the circular fitting hole or a horizontal width of the square fitting hole.

8. The detachable shelf according to claim 3, wherein the fitting groove comprises a first fitting groove and a second fitting groove symmetrically disposed, and the first fitting groove and the second fitting groove are spaced by a vertical spacing plate;

each of the first fitting groove and the second fitting groove comprises a semi-circular fitting hole or square fitting hole located at upper portion and a rectangular fitting hole or trapezoidal fitting hole located at lower portion;

a horizontal width of the rectangular fitting hole or trapezoidal fitting hole is less than a radius of the semi-circular fitting hole or a horizontal width of the square fitting hole.

9. The detachable shelf according to claim 8, wherein an arc-shaped protrusion facing toward the rectangular fitting hole or trapezoidal fitting hole is disposed at a position of the vertical spacing plate close to a top of the rectangular fitting hole or trapezoidal fitting hole.

10. The detachable shelf according to claim 2, wherein a middle portion of an outer side surface of the second vertical main plate of the second cross beam is inwardly recessed and a middle portion of an inner side surface is outwardly protruded, so as to form a second reinforcing portion.

11. The detachable shelf according to claim 1, wherein a middle portion of an outer side surface of the first vertical main plate of the first cross beam is inwardly recessed and a middle portion of an inner side surface is outwardly protruded, so as to form a first reinforcing portion.

* * * * *